United States Patent [19]

Kennedy

[11] Patent Number: 4,728,021

[45] Date of Patent: Mar. 1, 1988

[54] FASTENING MACHINE

[75] Inventor: George W. Kennedy, Pompano Beach, Fla.

[73] Assignee: Kentec, Inc., Decatur, Ga.

[21] Appl. No.: 882,345

[22] Filed: Jul. 7, 1986

[51] Int. Cl.[4] ..... B25C 1/04

[52] U.S. Cl. ..... 227/120; 227/109; 227/156

[58] Field of Search ..... 227/8, 78, 109, 120, 227/123, 132, 156

[56] References Cited

U.S. PATENT DOCUMENTS

| | | | |
|---|---|---|---|
| 2,160,514 | 5/1939 | Polzer | 227/109 |
| 3,022,509 | 2/1962 | De Man | 227/109 |
| 3,437,249 | 4/1969 | Baum | 227/120 |
| 4,199,095 | 4/1980 | Yamanof | 227/120 X |
| 4,558,811 | 12/1985 | Klaus | 227/120 X |

*Primary Examiner*—Paul A. Bell

*Attorney, Agent, or Firm*—Thomas & Kennedy

[57] ABSTRACT

An automatic fastening machine where clips of cohered fasteners (11, 15) fall freely onto a guide means (12) as they are needed and a fastener advancing means (13) intermittently urges the clips of fasteners toward a drive element (60). The drive element pushes the frontmost fastener on a clip into a work piece and an anti-jamming device (18–20) clears any jammed fasteners from the drive element.

21 Claims, 7 Drawing Figures

FASTENING MACHINE

BACKGROUND OF THE INVENTION

This invention relates in general to automatic fastening machines, particularly to automatic fastening machines used in a continuous production line where a plurality of machines are operated automatically to drive fasteners such as staples, nails and the like in a work product such as wooden lattices, pallets, fence panels and the like. For example, several fastening machines are mounted on a common frame above a surface conveyor which carries a work product underneath the fasteners, and triggering devices responsive to the movement of the work product to a predetermined position actuate the fastening machines which drive fasteners into the work product. These type systems run at a pace much faster than could be achieved in a manual operation. Therefore a large amount of fasteners consistently supplied in proper orientation is required.

In particular, this invention relates to the means by which the fasteners to be driven in the work piece are fed into the fastening machine. In the prior art, clips of cohered fasteners have been placed on a guide means with a spring biased pusher in contact with the rearmost fastener on the clip which urges the clip toward the driving head of the fastening machine. This method of urging the clip of fasteners toward the driving head ensures that fasteners are forced into the driver head section but this method also causes delays when a clip of fasteners has been exhausted because the pusher must be retracted to allow another clip of fasteners to be placed on the guide means. Such interruptions in production can be very costly due to lost productivity. Prior art systems also have been developed that automatically retrieve the pusher when a new clip of fasteners is needed, but these mechanisms are expensive and appear to cause many problems.

SUMMARY OF THE INVENTION

Briefly described, the present invention comprises a fastening machine of the type used in automated production systems in which work products such as wooden lattices, fence panels and wooden pallets are produced, whereby several fastening machines are mounted above a conveyor belt carrying the work product. Each fastening machine has its own clip of fasteners and drive element for inserting the fasteners from the end of the clip into the work product. A supply of clips of fasteners is contained in a fastener magazine which is positioned over a fastener advancing means that feeds the fasteners to the drive element. The fastener advancing means operates without the use of a traditional pusher and is open above and behind the fastener clip guide means which allows new clips of fasteners to move by gravity from the fastener magazine onto the guide means as the new clips are needed, thereby providing interruption-free production.

More particularly, the fastener advancing means comprises a fastener guide means upon which clips of fasteners from the fastener magazine travel in a upright attitude toward the drive element. The movement of the clips of fasteners along the guide means is caused by friction members engaging the side surfaces of the clip of fasteners and moving the friction members toward the drive element on each cycle of operation of the drive element of the fastening machine. Cam surfaces on the friction members, in conjunction with a pneumatic cylinder which applies a reciprocating motion thereto, provides the movement of these friction members.

The urging of the clip of fasteners by the friction members toward the drive element during each cycle of operation of the fastening machine ensures that the leading fastener of the clip of fasteners on the guide means will be urged toward the drive element as the drive element is actuated so that a fastener will be properly positioned beneath the drive element. As the clip of fasteners on the guide means is being used up so as to provide space for a new clip of fasteners on the guide means, a new clip of fasteners will fall onto the fastener guide means from the fastener clip magazine. Subsequently, the friction members will urge the new clip of fasteners into abutting position behind the partially depleted clip of fasteners.

Additionally, an anti-jamming gate which is free to open after each stroke of the drive element is provided to clear the fastening machine automatically in case a fastener is jammed while being driven into the work piece.

One embodiment of the invention comprises a fastening machine capable of driving U-shaped staples into the work piece. A plurality of staples are adhesively connected together to form a long U-shaped clip, and the clips are inverted when delivered to the fastener advancing means. The guide means comprises a rectilinear rail upon which the clips of staples travel in straddled relationship.

A second embodiment of the invention comprises a fastening machine capable of driving nails into the work piece. Each nail includes a rectilinear shank with a point at one end and an enlarged head at the other end. A plurality of nails are adhesively connected together at their heads with their long shanks extending parallel to form clips. The clips of nails are oriented with their points extending downwardly when delivered to the fastener advancing means. An indentation along the length of both sides of the fastener advancing means is positioned to form a groove corresponding to the shape of the nail head and act as the guide means.

Thus, it is an object of this invention to provide a fastening machine which will operate continuously for an extended period of time with minimal operator assistance necessary.

Another object of this invention is to provide a fastening machine which automatically supplies new clips of fasteners to the guide means of the fastener as the clips on the guide means are used up.

Other objects, features and advantages of the present invention will become apparent upon reading the following specification, when taken in conjunction with the accompanying drawings.

DETAILS OF THE PREFERRED EMBODIMENT

Figure 1:
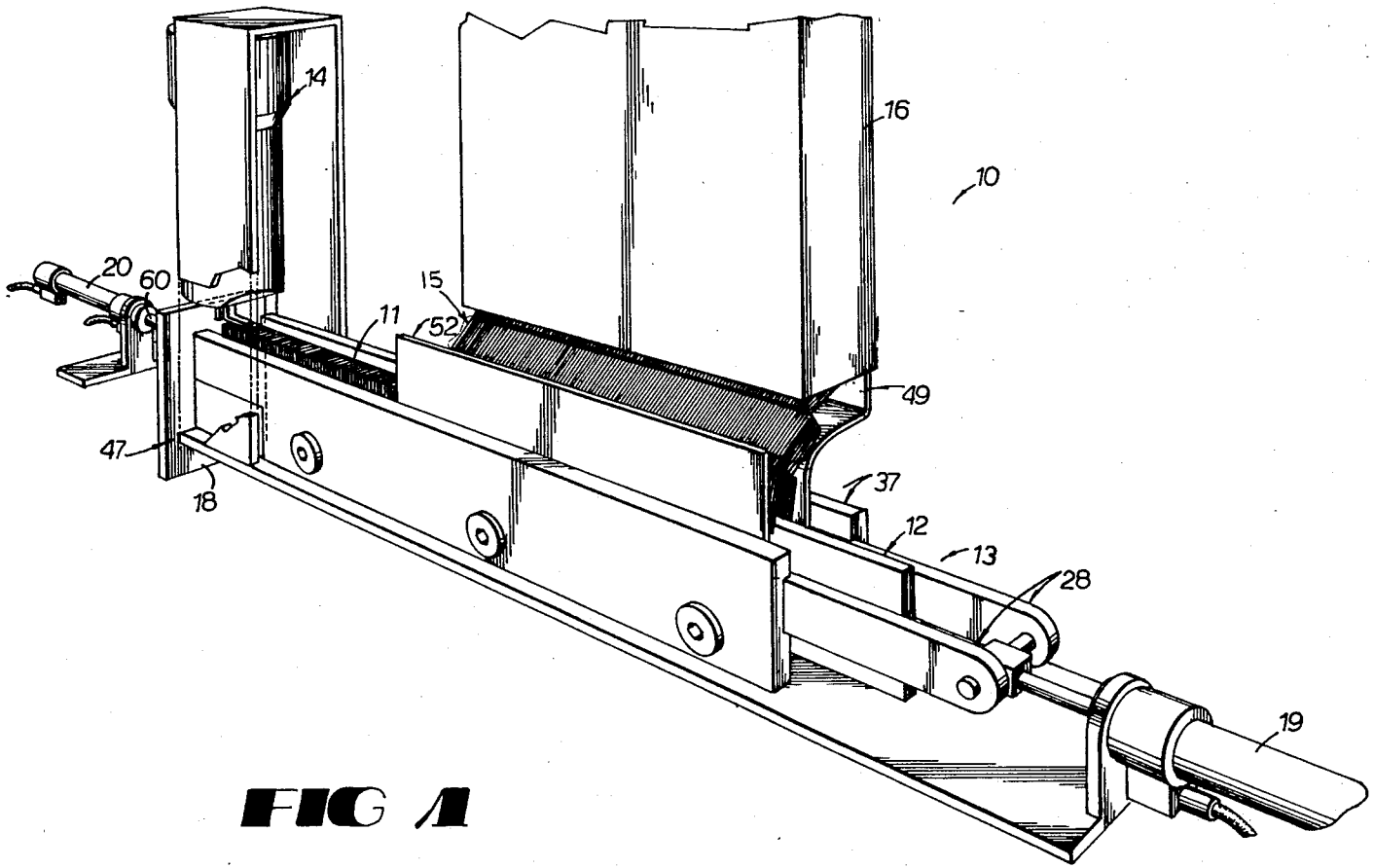
FIG. 1 is a perspective view, with parts broken away, of the fastening machine showing the basic components as they are when staples are used as the fastener.
Figure 2:
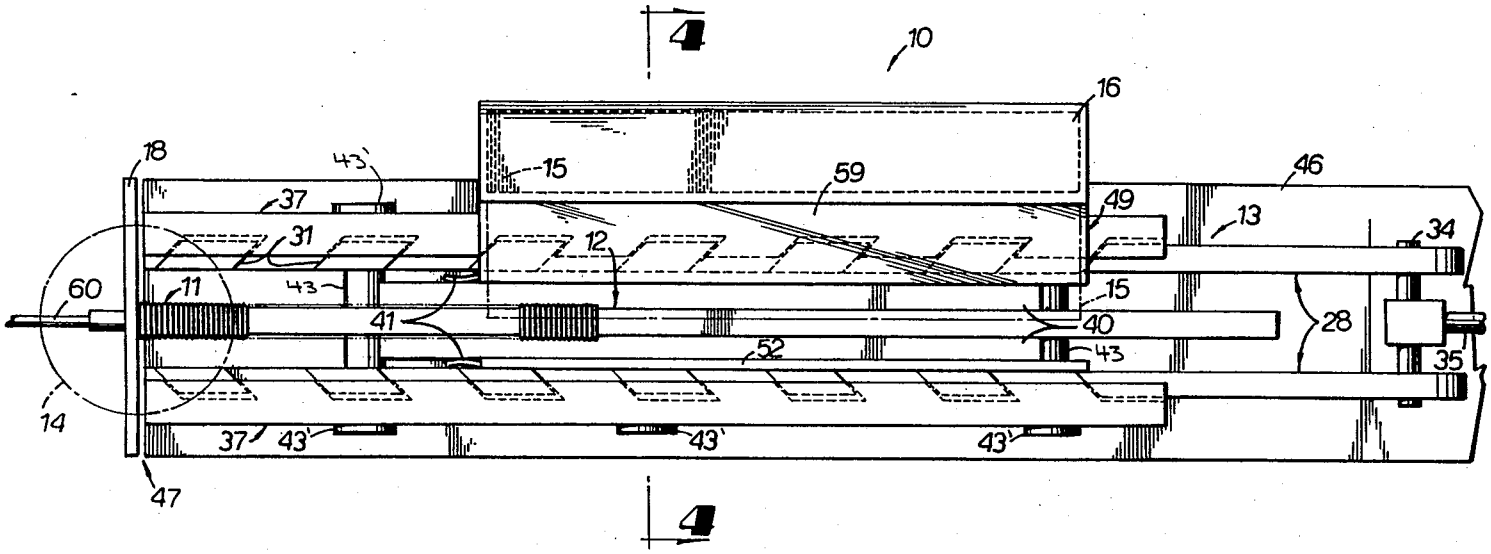
FIG. 2 is a plan view of the staple advancing means shown with a clip of staples on the staple guide.

Referring now in detail to the drawings in which like numerals indicate like parts throughout all views, FIG. 1 shows a staple machine 10 having a clip of staples 11 seated on staple guide 12 with staple advancing means 13 powered by pneumatic cylinder 19. The driver element 14 is shown directly over staple discharge gap 47 formed between staple guide 12 and discharge chute gate 18. Pneumatic cylinder 20 is shown with extension shaft 60 in its distended position abutting the backside of discharge chute gate 18. A supply of new clips of staples is contained in magazine 16 with the lowermost clips 15 of the supply positioned on the sloped staple clip chute 49 which extends from the lower open end of the magazine toward the staple guide rail 12.

Figure 3:
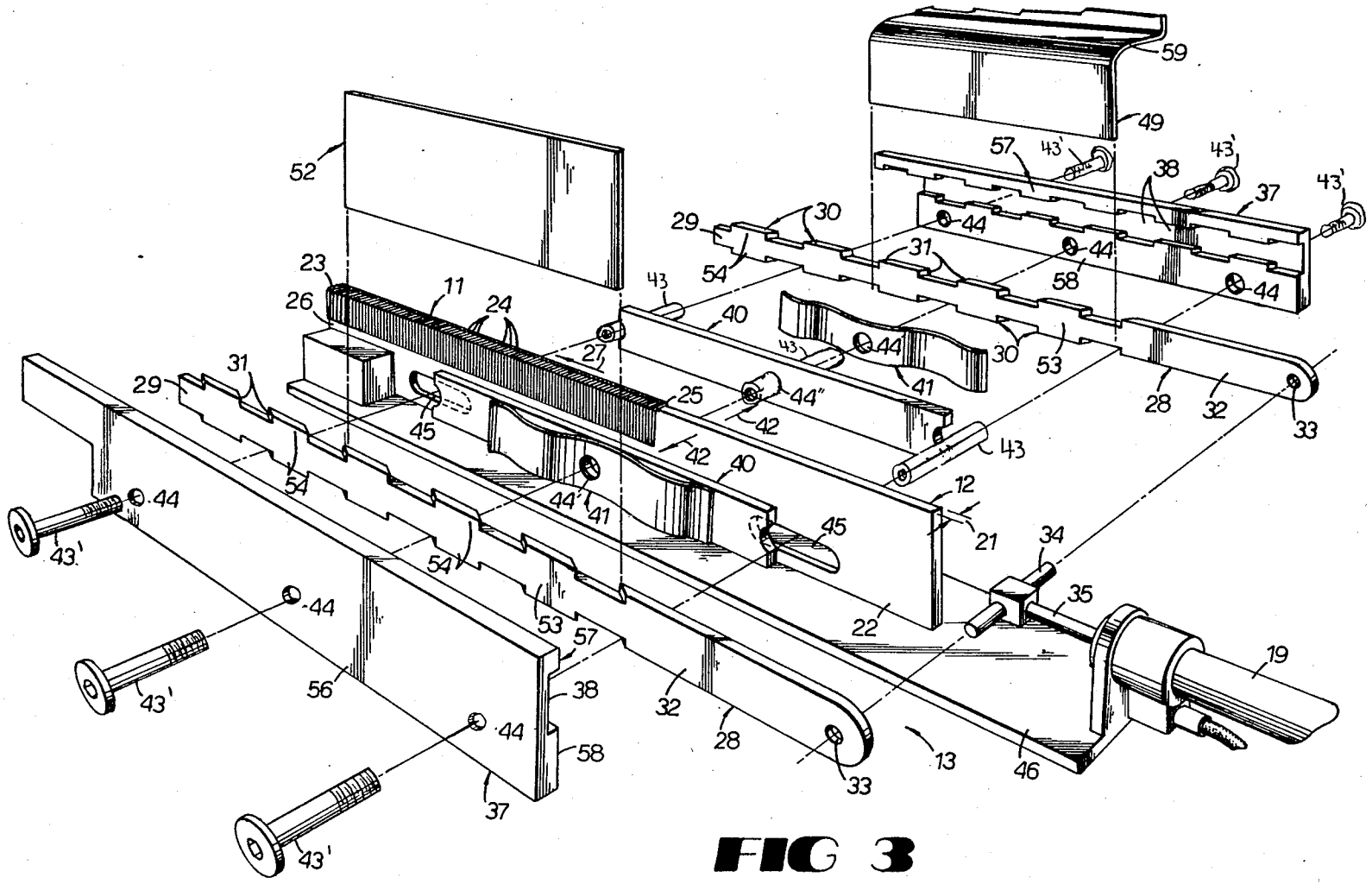
FIG. 3 is an exploded perspective view of the staple advancing means showing details of the assembly.

Looking in more detail now at the staple advancing means 13, FIG. 3 shows the staple guide 12 with width 21, vertical sides 22, discharge end 26 and horizontal support plate 46. Several slotted mounting openings 45 extend between the vertical sides 22 just above the horizontal support plate 46. A clip of staples 11 is seen sitting in straddled relationship on the staple guide 12. The clip of staples 11 has a frontmost staple 23, intermediate staples 24 and a rear staple 25.

Figure 5:
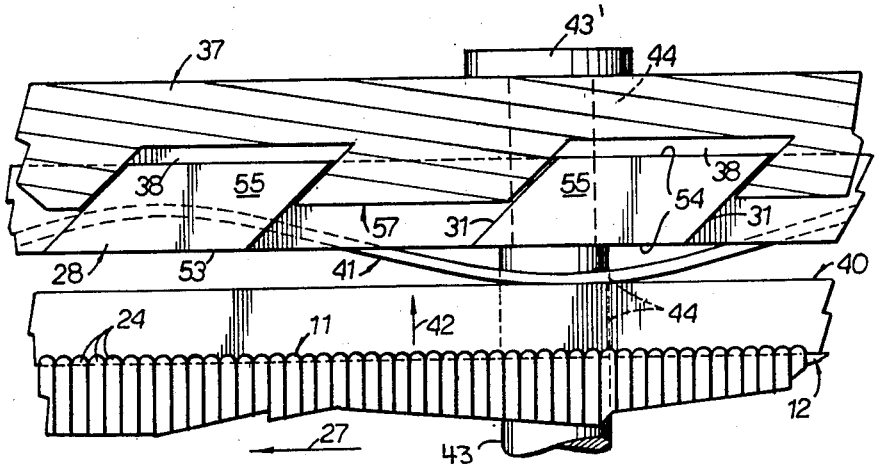
FIG. 5 is a close up detail top view of the cam surfaces in relation to the clip of staples.

There are two inside cam plates 28, one on each side of staple guide 12, extending parallel to staple guide 12 and each having a rectilinear main body 53 with front section 29 and rear section 32. A plurality of cam protrusions 30 extend vertically from the rectilinear main body 53 and are spaced equidistant along a length of the inside cam plate 28. Each cam protrusion 30 has two side surfaces 54 and two cam surfaces 31. The side surfaces 54 are flush extensions of rectilinear main body 53 and are offset longitudinally from each other such that the cam surfaces 31 which run between the side surfaces 54 are not perpendicular to the side surfaces 54. As shown in FIG. 5, the outer perimeter of the protrusions 30 which is formed by the top edges of cam surfaces 31 and side surfaces 54 has the shape of a parallelogram. Looking back now to FIG. 3, all of the cam surfaces 31 along an inside cam plate 28 run parallel to one another and the two inside cam plates 28 have shapes that are mirror images of one another. The rear section 32 of each inside cam plate 28 has a circular opening 33 extending therethrough perpendicular to the staple guide 12.

As illustrated in FIG. 3, two outside cam plates 37 are positioned parallel to staple guide 12 and just outside the inside cam plates 28. Each of the outside cam plates 37 has a rectangular outer periphery 56 and a plurality of circular mounting holes 44 extending therethrough perpendicular to the staple guide 12. The inner engaging sides 57 of outside cam plates 37 have cam surface indentations 38 of depth and configuration to match the thickness and configuration of the inside cam plate 28 adjacent thereto. The engaging sides 57 also have bearing surfaces 58 located just below the cam surface indentations 38 and running the length of the outside cam plates 37.

Two rectilinear friction bars 40 extend parallel to and on either side of staple guide 12 and are seated on horizontal support plate 46. A leaf spring member 41 extending the length of friction bar 40 also is placed on horizontal support plate 46 juxtaposed friction bar 40. The spring member is positioned such that the direction of spring force 42 extends perpendicularly outward from the vertical sides 22 of staple guide 12.

Connecting pin 34 extends through the two circular mounting openings 33 of inside cam plates 28, and is attached to extension shaft 35 of pneumatic cylinder 19. Spacers 43 are inserted through slotted mounting openings 45 in the staple guide 12, with the middle spacer 43 also extending through the aligned mounting openings 44' and 44'' of spring members 41 and friction bars 40, respectively. The entire staple advancing means is assembled by extending connectors 43' through the openings 44 of outside cam plates 37 on both sides of the staple guide and threading connectors 43' into both ends of spacers 43.

Once assembled, outside cam plates 37 will rest upon the horizontal support plates 46, with bearing surfaces 58 abutting spring members 41. The spacers 43 tend to position the engaging sides 57 of outside cam plates 37 away from the vertical sides 22 of staple guide 12 a distance slightly less than the thickness of inside cam plates 28. The force applied by spring members 41 on both sides of the staple guide 12 tends to keep the outside cam plates "centered". Thus, because inside cam plates 28 are recessed into the cam surface indentations 38 when assembled, they have no means of escaping from the assembly when moved in the direction of the staple clip feed arrow 27.

Figure 4:
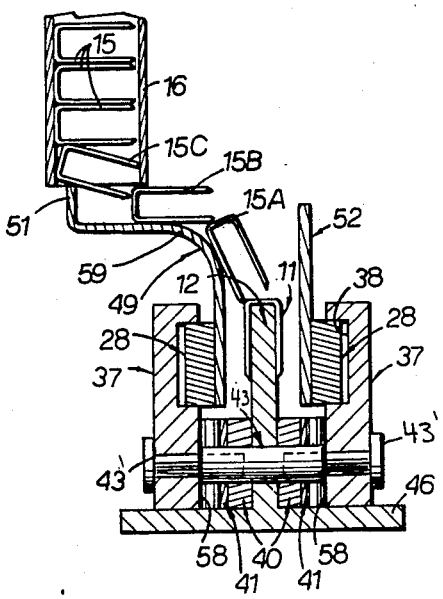
FIG. 4 is a cross sectional view of the staple advancing means showing the path of clips of staples from the magazine to the staple guide.

As shown in FIG. 4, the spatial relationship between outside cam plates 37 and staple guide 12, provided by spacers 43, spring members 41 and friction bar 40, can be seen more clearly. Also shown in FIG. 4 is the staple clip positioning plate 52 rigidly attached to the inside surface of inside cam plate 28 on one side of staple guide 12, and staple clip chute 49 rigidly attached to the inside surface of the inside cam plate 28 on the other side of staple guide 12. The staple clip chute 49 has an upper edge 51 and a curved sliding section 59. Both staple clip positioning plate 52 and staple clip chute 49 extend parallel to staple guide 12 and have a length in this direction slightly longer than that of a clip of staples 11. Staple clip magazine 16 extends vertically upwardly from upper edge 51 of staple clip chute 49 and contains the awaiting new clips of staples 15 in an orientation which is parallel to the clip of staples 11 on the staple guide 12, but rotated longitudinally from that position.

OPERATION

The operation of the stapling machine begins with pneumatic cylinder 20 pushing extension shaft 60 out to its distended position thereby holding discharge chute gate 18 in the proper position, at the same time pneumatic cylinder 19 begins extending from its retracted position thus causing the inside cam plates 28 to begin their forward motion. As the inside cam plates 28 start to move, the engagement of their cam surfaces 31 with cam surface indentations 38 on the outside cam plates 37 causes the inside cam plates 28 to move inwardly toward the clip of staples 11 and forward towards the discharge end 26. Once the positioning plate 52 and chute 49 have been moved by inside cam plates 28 into contact with the clip of staples 11, further inward movement of the cam plates 28 and positioning plate 52 and chute 49 is prevented, but these elements continue their motion forward in response to the force applied by cylinder 19. Because the outside cam plates 37, spring members 41 and friction bars 40 are all tied together with connectors 43, they will all move forward with the inside cam plate 28 with the spacers 43 travelling along the slotted mounting openings 45 in the stationary staple guide 12. The clip of staples 11 will move forward with the inside cam plates 28 until the frontmost staple 23 has abutted the discharge chute gate 18. The distance the inside cam plates 28 will travel, however, is greater than the distance the clip of staples 11 will normally advance when only the frontmost staple has been previously driven off the clip of staples. Thus, the inside cam plates 28 will continue to move along the outside surfaces of the clip of staples 11 in sliding frictional contact, thereby assuring that the frontmost staple 23 will be firmly held against discharge chute gate 18.

The pneumatic cylinders 19 and 20 are both connected to the same air supply with a special valve governing the flow of air to the drive element 14. This valve assures that the extension shafts 60 and 35 of pneumatic cylinders 20 and 19 have been completely extended before driver element 14 begins its travel downward to the frontmost staple.

Shortly after the drive element 14 has driven the frontmost staple 23 into the work piece, the pneumatic cylinders 19 and 20 will begin to withdraw their extension shafts 35 and 60. As extension shaft 35 retracts away from the drive element, the inside cam plates 28 positioning plate 52 and chute 49 will begin to move away from the clip of staples 11 immediately due to the engagement of cam surfaces 31 with cam surface indentations 38. As the protrusions 30 become fully recessed back in the cam surface indentations 38 of outside cam plates 37, the entire assembly of outside cam plates 37, spring members, 41 friction bars 40, spacers 43 and connectors 43' will start to move backwards with the inside cam plates 28 positioning plate 52 and chute 49. Once the pneumatic cylinder 19 has completed its return stroke, the entire staple advancing means will rest in its rearmost position until the sequence begins again.

In the event that the drive element 14 becomes wedged against the discharge chute gate 18 because the frontmost staple 23 was "jammed" in the discharge gap 47, the discharge chute gate 18 will swing open and allow the "jammed" staple to fall clear of the discharge gap 47 at this point because the pneumatic cylinder 20 has retracted extension shaft 60 and is not restricting movement of the discharge chute gate 18, and drive element 14 will return to complete its cycle.

Waiting clips of staples 15 are positioned on staple clip chute 49 such that as the clip of staples 11 straddled on staple guide 12 nears depletion, a space becomes available on the staple guide 12 for a new clip of staples and the waiting clip of staples 15A closest to staple guide 12 will fall into the space on the staple guide. Because the staple clip chute 49 and staple clip positioning plate 52 are attached to the inside cam plates 28, the movements of the inside cam plates 28 are transmitted to the waiting clips of staples 15, causing some vibrations to these new clips of staples which results in the lower most new clip 15A dropping into straddling position on the staple guide. As the waiting clip of staples 15 becomes straddled on the staple guide 12, it will be urged by the inside cam plates 28 towards the end staple 23 of staple clip 11. Any gap existing between the end staple of staple clip 11 in the frontmost staple of new clip of staples 15A will be closed immediately due to the excess travel of the inside cam plates 28 mentioned earlier. Once the waiting clip of staples 15A has vacated its place on the staple clip chute 49, the next clip of staples 15B on the chute will slide down and a clip of staples 15C will fall out of the magazine 16 onto the slide section 59 of the staple clip chute 49.

The supply of staples in the magazine 16 is sufficient enough such that the operator need come by only every few hours to put new staples in it and ensure continuous action by the stapling mechanism.

DETAILS OF AN ADDITIONAL EMBODIMENT

Figure 6:
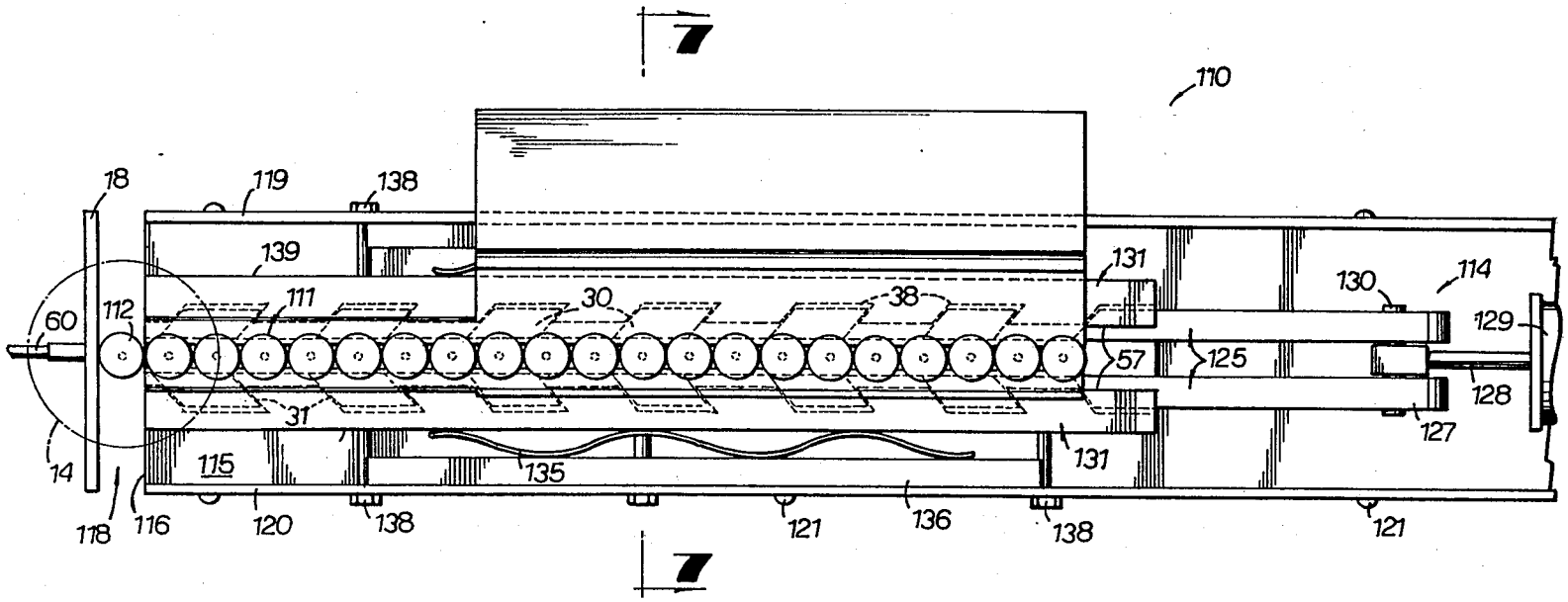
FIG. 6 is a plan view of a second embodiment of the fastener advancing means as it appears when nails are used as the fastener.
Figure 7:
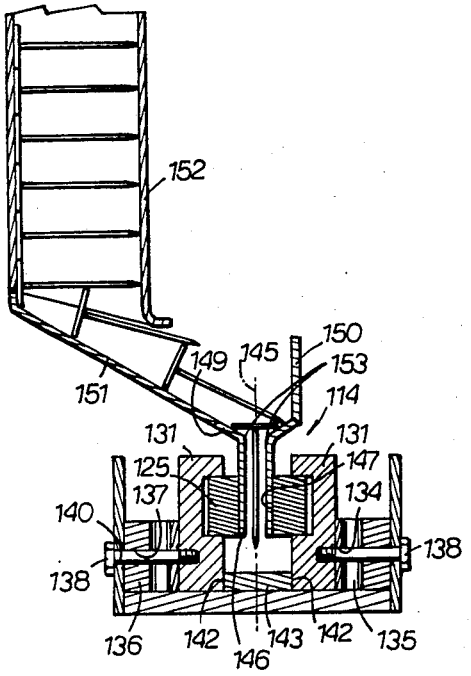
FIG. 7 is a cross-sectional view of the nail advancing means.

The embodiment of the invention as it appears when nails are the preferred fastener is shown in FIGS. 6 and 7.

FIG. 6 is a plan view of the nailing machine 110 with clips of nails 111 shown with frontmost nail 112 forced into abutment with discharge chute gate 18 by the nail advancing mechanism 114. Drive element 14 is not shown but is represented by the phantom circle centered over frontmost nail 112. Horizontal mounting plate 115 is positioned such that its front edge 116 forms a nail discharge gap 118 with discharge chute gate 18 when extension shaft 60 of pneumatic cylinder 20 is in its distended position. Housing sides 119 and 120 are mounted to horizontal mounting plate 115 by connectors 121.

Looking in more detail at the nail advancing mechanism 114, FIG. 6 shows two inside cam plates 125 attached at their tail ends 127 to extension shaft 128 of pneumatic cylinder 129 by connecting pin 130. Two outside cam plates 131 extend parallel to and just outside of inside cam plates 125. The inside cam plates have cam protrusions 30, cam surfaces 31 and side surfaces 54 which interact with inner engaging sides 57 and cam surface indentations 38 of outside cam plates 131 as described earlier in the embodiment of the stapler. Spring members 135 and friction bars 136 are placed between outside cam plates 131 and housing sides 119 and 120. Connectors 138 rigidly mounted to the outer sides 139 of outside cam plates 131 extended through aligned openings 134 and 137 in spring members 135 and friction bars 136 and through mounting slots 140 in housing sides 119 and 120.

Looking at FIG. 7, the outside cam plates 131 are shown connected at their lower inside edges 142 by connecting plate 143. Thus, the outside cam plates 131 are held in positions on either side of and equidistant from the centerline 145 of the nail advancing mechanism 114. The inside cam plates 125 have a nail guide plate 146 attached to their inside surfaces 147, and the nail guide plates 146 have upper flanges 149 extending outwardly. A nail clip positioning plate 150 extends vertically from one upper flange 149 and a nail clip chute 151 slopes upwardly away from the other upper flange 149 to a position under nail clip magazine 152.

The operation of the nailing machine 110 is similar to that of the stapling machine 10 described earlier. The only difference being that instead of the staples riding on a guide rail, the clips of nails are guided by the two upper flanges 149. These two upper flanges 149 are attached to nail guide plates 146 which are attached to inside cam plates 125. Therefore the upper flanges 149 move in an out with the inside cam plates 125 but corners 153 are never farther apart than the diameter of the head of the nail. This allows the clips of nails 111 to be carried along the upper flanges 149 as the nail advancing mechanism 114 is urging the clip of nails 111 toward the drive element 14.

While this invention has been described in detail with particular reference to embodiments that prefer nails or staples as the fastener to be used, it remains obvious that the invention disclosed herein could be applied to other types of fasteners.

It will be understood that the foregoing relates only to preferred embodiments of the present invention, and that numerous changes and modifications may be made therein without departing from the spirit and scope of the invention as set forth in the following claims.

I claim:

1. A fastening machine of the type used to drive fasteners from an end of a clip of fasteners into a work product, the clip of fasteners comprising fasteners connected to one another in an enlogated clip of aligned, parallel fasteners, said fastener machine including a guide means having a fastener discharge end, a drive element at the discharge end of said guide means for driving the endmost fastener at one end of the clip from the clip of fasteners on said guide means, and fastener advancing means for maintaining the endmost fastener of the clip of fasteners on said guide means at a position adjacent said drive element, the improvement therein comprising, said fastener advancing means including at least one clip engaging element positioned out of alignment with the length of the clip of fasteners, and means for intermittently urging said clip engaging element into contact with an intermediate portion of said clip and moving the clip engaging element toward the drive element for frictionally engaging the clip and urging the clip along the length of the guide means toward the drive element.

2. The fastening machine of claim 1 and wherein said clip engaging element comprises a pair of clip engaging members positioned on opposite sides of said guide means, and wherein said means for intermittantly urging said clip comprises means for simultaneously urging said clip engaging members toward said guide means and along the length of said guide means toward the discharge end of said guide means, whereby the clip engaging members engage and urge the clip of fasteners on the guide means toward a position adjacent the drive element.

3. The fastening machine of claim 1 and wherein the upper surface of said guide means is unobstructed by said fastener advancing means, and further including a fastener clip magazine for mounting over said guide means and arranged to support a plurality of fastener clips in stacked relationship above and in alignment with said guide means, whereby when the fastener clip on the guide means moves out of the way of the fastener clip next above in the magazine, a fastener clip will move down from the magazine onto the guide means.

4. The fastening machine of claim 1 and further including a fastener clip loading means for depositing new clips of fasteners onto said guide means, said fastener clip loading means comprising a fastener clip magazine extending upwardly from said guide means to a height sufficient for holding a plurality of clips of fasteners above said guide means, said clips of fasteners being placed in said magazine parallel to said guide means and oriented generally horizontally, said magazine being offset horizontally from said guide means, a fastener chute sloped between a position beneath said magazine and a position over said guide means so that clips of fasteners can travel down through said magazine and through said fastener chute and onto said guide means.

5. A fastening machine of the type used to drive fasteners from an end of a clip of fasteners into a work product, the clip of fasteners comprising fasteners connected to one another in an elongated clip of aligned, parallel fasteners, said fastener machine including a guide means having a fastener discharge end, a drive element at the discharge end of said guide means for driving the endmost fastener at one end of the clip from the clip of fasteners on said guide means, and fastener advancing means for maintaining the endmost fastener of the clip of fasteners on said guide means at a position adjacent said drive element, the improvement therein comprising, said fastener advancing means including at least one clip engaging element positioned out of alignment with the length of the clip of fasteners and drive means for intermittantly urging said clip engaging element into contact with an intermediate portion of said clip and for urging said clip along the length of said guide means toward said drive element, a discharge gate with a front fastener bearing surface movable toward and away from the fastener discharge end of said guide means, said discharge gate when in its closed position being in spaced relation to said guide means and forming therewith a fastener discharge gap through which said drive element drives the endmost fastener from said clip and when in its open position is displaced further from said guide means, said discharge gate including a fluid actuated cylinder arranged to control movement of said discharge gate toward and away from the discharge end of said guide means, said cylinder comprising system logic to relieve pressure from said discharge gate at specified times, whereby any fasteners jammed in the fastener discharge gap will tend to urge the discharge gate to move away from the discharge end of the guide means and the jammed fastener will tend to fall clear of said fastener discharge gap.

6. A fastening machine of the type used to drive fasteners from an end of a clip of fasteners into a work product, the clip of fasteners comprising fasteners connected to one another in an elongated clip of aligned, parallel fasteners, said fastener machine including a guide means having a fastener discharge end, a drive element at the discharge end of said guide means for driving the endmost fastener at one end of the clip from the clip of fasteners on said guide means, and fastener advancing means for maintaining the endmost fastener of the clip of fasteners on said guide means at a position adjacent said drive element, the improvement therein comprising, said fastener advancing means including at least one clip engaging element positioned out of alignment with the length of the clip of fasteners and drive means for intermittantly urging said clip engaging element into contact with an intermediate portion of said clip and for urging said clip along the length of said guide means toward said drive element, said clip engaging element comprises a first pair of inside cam plates straddling said guide means, a second pair of outside cam plates straddling said inside cam plates, said inside and outside cam plates including engaging cam surfaces which cooperate to urge said inside cam plates toward and along the length of said guide means in response to the movement of the cam plates toward the drive element.

7. The fastening machine of claim 6 and wherein said fastener advancing means includes fluid actuated power means for reciprocating said cam plates, 8. A stapling mechanism of the type used to drive into a work piece inverted U-shaped staples, each staple having two parallel side legs and a cross leg connected at its ends to an end of a side leg, a plurality of said staples being connected together in a parallel, aligned and stacked fashion to form clips, each said clip having a front staple, a rear staple and a plurality of intermediate staples, said staple machine including a rectilinear staple guide, a drive element at one end of said staple guide for driving the frontmost staple from a clip of staples positioned on said staple guide, and staple advancing means for maintaining said frontmost staple of a clip at a position adjacent said driver element, the improvement therein comprising, said rectilinear staple guide having a width slightly smaller than the space between the parallel side legs of said U-shaped staples, two parallel vertical sides of a height taller than the legs of said U-shaped staples, and a length greater than the length of one said clip of staples, the width, vertical sides and length of said rectilinear staple guide forming a shape which allows at least one said clip of staples to be positioned in longitudinally straddled relationship on said rectilinear staple guide, said rectilinear staple guide having a discharge end positioned adjacent to said driver element, said staple advancing means including two inside cam plates, each of said inside cam plates located adjacent and parallel to one of the vertical sides of said rectilinear staple guide, said inside cam plates comprising a rectilinear main body extending generally parallel to said rectilinear staple guide with cam surfaces formed thereon, said staple advancing means also including two outside cam plates, said outside cam plates straddling said inside cam plates, said outside cam plates including cam surfaces formed thereon, said cam surfaces being of a shape such that when said inside cam plates are moved along their lengths toward the discharge end of said rectilinear staple guide, the cam surfaces of said inside cam plates and of said outside cam plates engage each other and wedge said inside cam plates toward lateral engagement with the clip of staples on said rectilinear staple guide and urge the clip of staples toward the discharge end of said rectilinear staple guide, said staple advancing means additionally including a power means in driving relation with respect to said inside cam plates, said power means providing an intermittent reciprocating motion to said inside cam plates, a positioning means for basing said inside cam plates toward a predetermined spaced relationship with respect to said rectilinear staple guide, and a front stapie bearing surface positioned adjacent the discharge end of said rectilinear staple guide and forming with said rectilinear staple guide a staple discharge gap between said front staple bearing surface and the discharge end of said rectilinear staple guide, said gap being of a size and shape to pass only the frontmost staple from the clip of staples on said rectilinear staple guide.

9. The stapling machine of claim 8 and further including a staple clip loading system for placing new clips of staples onto said staple guide as the previous staple clip on the staple guide is exhausted, said staple clip loading system comprised of a staple clip chute attached to one of said inside cam plates, said staple clip chute extending parallel to and bending vertically away from said staple guide, said staple clip loading system also including a staple clip positioning plate attached to the inside cam plate opposite of said inside cam plate having said staple clip chute attached thereto, said staple clip positioning plate extending parallel to said staple guide, said staple clip loading system additionally including a staple clip magazine extending vertically upward from said staple clip chute, said staple clip magazine being of a height sufficient to hold several clips of staples, said clips being placed in said magazine parallel to said staple guide but rotated such that the parallel side legs of the staples in said clips are all pointing generally horizontal, and said magazine being located over said chute such that as the staple clips fall out of the magazine, said clips slide down said chute and onto said staple guide.

10. The stapling machine of claim 8 and wherein said positioning means comprises two friction bars, each said friction bar contacting one of the vertical sides of said rectilinear staple guide just below the legs of said clips of staples, said friction bars extending generally parallel to said rectilinear staple guide, said positioning means also including two spring members, each said spring member juxtaposed to one of said friction bars with the general direction of spring force of said spring members being perpendicular to the vertical sides of said rectilinear staple guide, said outside cam plates, said springs, said friction bars and said staple guide all defining aligned openings therethrough, and at least one connector extending through said aligned openings, said connector being of a length sufficient to hold said rectilinear staple guide and said outside cam plates in said predetermined spatial relationship.

11. The stapling machine of claim 8 and wherein said power means includes a pneumatic cylinder with extension shaft extending parallel to said rectilinear staple guide and connected to said inside cam plates, and air system logic to drive the extension shaft of said pneumatic cylinder in a predetermined intermittent reciprocating motion.

12. The stapling machine of claim 8 and further including means for movably supporting said front staple bearing surface including a fluid actuated cylinder, whereby said fluid actuated cylinder restricts movement of said front staple bearing surface away from said staple discharge gap, said fluid actuated cylinder including system logic to depressurize at predetermined times, free to move away from said staple discharge gap, whereby any staples jammed in the staple discharge gap can be cleared.

13. A method of feeding fasteners to a position at the drive element of a fastening machine including a guide means and a driver element at one end of the guide means, the fasteners arranged in a clip of connected series of fasteners and with the sides of the fasteners forming side surfaces of the clip, comprising the steps of;

placing a clip of fasteners on said guide means, moving a friction member from a position spaced from the clip laterally into engagement with the side surfaces of the clip and toward the driver element and urging the side surfaces of the clip with the moving friction member along the length of the guide means toward the position of the driver element, and after the clip is engaged and is being urged by the friction member toward the driver element, driving the leading fastener of the clip with the driver element.

14. The method of claim 13 and wherein after the driver element has driven the leading fastener from the clip withdrawing the friction members from engagement with the side surfaces of the clip, and returning the friction members to a position from which the friction members can begin the engagement cycle again.

15. A method of freeing jammed fasteners from a fastening machine which includes a fastener guide means for supporting a clip of fasteners, a fastener abutment plate normally positioned in spaced relationship with respect to one end of the guide means and defining a fastener discharge channel with the guide means at which the endmost fastener of the clip of fasteners normally rests, and a drive element movable through the fastener discharge channel for driving the endmost fastener into a work product, the steps of applying a holding force to the abutment plate to urge the abutment plate toward its spaced position as the drive element drives the fastener through the discharge channel, and relieving the holding force from the abutment plate after the drive element has driven a fastener through the discharge channel to permit the abutment plate to freely move away from the guide means and allow any fastener jammed in the discharge channel to fall from the discharge channel.

16. The method of claim 15 and further including the steps of applying a moving force to the clip of fasteners to urge the clip along the guide means toward the fastener abutment plate as the drive element drives the fastener through the discharge channel, and relieving the moving force when the holding force is relieved from the abutment plate.

17. The method of claim 15 and wherein the step of applying a holding force to the abutment plate comprises moving the abutment plate toward its spaced relationship with respect to the guide means, and the step of relieving the holding force from the abutment plate comprises moving the abutment plate away from the guide means.

18. In a fastening machine of the type used to drive fasteners into a work piece comprising a guide means with a discharge end, a fastener abutment plate positioned adjacent the discharge end of said guide means and forming therewith a fastener discharge channel, a drive element movable in said channel to drive fasteners through said fastener discharge channel into a work piece, means for urging the fasteners toward the discharge end of said guide means, the improvement therein comprising means for alternately forcing said fastener abutment plate toward the discharge end of said guide means as said drive elementmoves through said discharge channel to drive a fastener through the channel and then relieving the force after the drive element has moved through the discharge channel, whereby if the drive element and/or any fasteners are jammed in the fastener discharge channel they will tend to move clear of the fastener discharge channel when the force applied to the fastener abutment plate is relieved.

19. The fastening machine of claim 18 and further including means movably supporting said abutment plate, wherein said means for forcing said fastener abutment plate comprises a fluid actuated cylinder with an extension shaft having distended and retracted positions arranged such that when said fluid actuated cylinder is in said distended position, said extension shaft contacts said abutment plate on a side opposite of said discharge channel and said abutment plate is maintained in proper relation to the discharge end of said guide means to form said discharge channel, and when said fluid actuated cylinder is in its retracted position, said extension shaft is withdrawn from contact with said abutment plate and said abutment plate can move away from said guide means.

20. The fastening machine of claim 18 and wherein said means for urging the fasteners toward the discharge end of the guide means comprises at least one clip engaging element positioned out of alignment with the length of the clip of fasteners, means for alternately urging said clip engaging element into contact with an intermediate portion of said clip and urging said clip along the length of said guide means toward said drive element when said abutment plate is forced toward the discharge end of said guide means and for retracting said clip engaging element from said clip when the force if relieved from said abutment plate

21. A fastening machine of the type to drive fasteners from the end of a clip of fasteners into a work product, said fastening machine including a rectilinear guide for supporting clips of fasteners and a front bearing surface spaced from an end of said rectilinear guide to form a staple discharge gap, and means for urging the staples along the rectilinear guide into abutment with said front bearing surface, means for movably supporting said front staple bearing surface including a fluid actuated cylinder, whereby said fluid actuated cylinder restricts movement of said front staple bearing surface away from said staple discharge gap, said fluid actuated cylinder including system logic to depressurize at predetermined times, said front staple bearing surface becoming, at these times, free to move away from said staple discharge gap, whereby any staples jammed in the staple discharge gap can be cleared.

* * * * *